United States Patent [19]

Combette et al.

[11] 4,199,093

[45] Apr. 22, 1980

[54] SELF-CLOSING PROPELLANT CHARGE PACKAGE

[75] Inventors: Marc Combette; Jean Ollivier, both of Valence, France

[73] Assignee: Societe de Prospection et d'Inventions Techniques S.P.I.T, Bourg-les-Valence, France

[21] Appl. No.: 940,938

[22] Filed: Sep. 11, 1978

Related U.S. Application Data

[63] Continuation of Ser. No. 841,783, Oct. 13, 1977, abandoned.

[51] Int. Cl.[2] ..... B25C 1/00; B25C 1/10; F41C 25/00

[52] U.S. Cl. ..... 227/9; 42/87; 206/3; 206/338; 221/307

[58] Field of Search ..... 206/3, 445, 303, 535, 206/338; 221/307, 310, 64, 198, 197, 283; 42/87, 49; 124/45, 49, 50; 229/7 R; 273/32 D; 227/9

[56] References Cited

U.S. PATENT DOCUMENTS

| | | | |
|---|---|---|---|
| 1,073,348 | 9/1913 | Hoagland | 42/87 |
| 2,108,902 | 2/1938 | Rasmussen | 229/7 R |
| 2,431,121 | 11/1947 | Hunter | 221/307 |
| 3,242,609 | 3/1966 | Koistinen | 42/87 |

FOREIGN PATENT DOCUMENTS

| | | | |
|---|---|---|---|
| 384139 | 12/1932 | United Kingdom | 206/535 |

*Primary Examiner*—William T. Dixson, Jr.
*Attorney, Agent, or Firm*—William W. Jones; Paul J. Lerner

[57] ABSTRACT

The present invention relates to a self-closing propellant charge package adapted for use with a gravity operated loading device of a power-actuated tool. The package comprises a tubular body having one end at least partially closed, the other end being open. A portion of the body adjacent the open end is deformed for holding the charges, it being possible to cancel the deformation of this portion to allow passage for the charges. More specifically, at least one cut-out is provided in the deformable portion, the portion being maintained in a deformed state by a resilient ring or other means.

10 Claims, 9 Drawing Figures

SELF-CLOSING PROPELLANT CHARGE PACKAGE

This is a continuation of application Ser. No. 841,783, filed Oct. 13, 1977 now abandoned.

The present invention relates to a self-closing propellant charge package adapted for use with a gravity operated loading device of a power-actuated tool.

In order to assume the double function of packaging and loading, such a device must retain the charges when it is not mounted on the tool, and let them come out when it is mounted.

Packages assuming these functions are already known. Some of them have an open and plastically deformed end in order to hold their content, the deformation of this end being cancelled for providing passage for the contents. Others have an end which is provided with a substantially semi-circular part, turned over towards the other end, for retaining the charges by their edge, and upon which is carried a slidable sleeve which may be positioned to prevent the charges escaping from the package.

The first mentioned type of packages are generally in the form of male members adapted for penetrating into a reception recess of a loading device of the tool. This arrangement displays certain disadvantages. After repeated use of this type of package involving repeated reformation of the deformed male member, the plastic deformation of the end gradually disappears, whereupon the propellant charges are no longer sufficiently held for allowing their handling in safety.

As regards the second type of package, it is particularly complicated to manufacture as the sliding sleeve requires costly manufacturing tolerances.

It is an object of the present invention, therefore, to obviate the various disadvantages of the known packages. This is accomplished, generally, by a tubular propellant charge package having one end at least partially closed, the other end being open, and having a portion, adjacent to the open end, which is deformed for holding the charges, it being possible to cancel the deformation of this portion for allowing passage of the charges. More specifically, at least one cut-out is provided in the deformable portion, the portion being maintained in a deformed state by a resilient ring.

In a preferred embodiment of the package of the present invention, the cut-out forms an opening in the wall of the deformable portion which portion is surrounded by a resilient ring.

Due to this opening, the resilient ring, when the tubular package of the invention is not on the fastener driving tool, causes a reduction of the passage cross-section of the package portion, said cross-section being reduced in comparison with that of the remaining part of the package in order to prevent the charges from coming out.

In another embodiment of the invention, the cut-out forms a tang which, when urged into the interior of the package, reduces the passage cross-section of it.

In such a case, the tang may be maintained in an interior position by the influence of a resilient ring. Alternatively, it can also be directly manufactured in position, the connecting area of the tang with the tubular package wall forming a resilient hinge.

For manufacturing reasons, and in particular if the package according to the invention is to be made by extrusion, the deformable portion may advantageously be manufactured separately and then connected to the non-deformed part of the package.

BRIEF DESCRIPTION OF THE DRAWINGS

The foregoing and other features of the invention will now be more particularly described in connection with two illustrative embodiments of the propellant charge package according to the invention, and with reference to the accompanying drawing thereof, in which:

FIGS. 1 to 4 show a package including a tubular body 1 having its rear end 2 deformed, for instance by heat, to provide a closure with an opening 3 of a diameter less than that of the propellant charges to be contained.

DESCRIPTION OF THE PREFERRED EMBODIMENT

Figure 2:
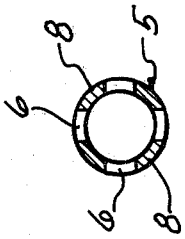
FIG. 2 is a transverse cross-sectional view along line II—II of FIG. 1.
Figure 1:
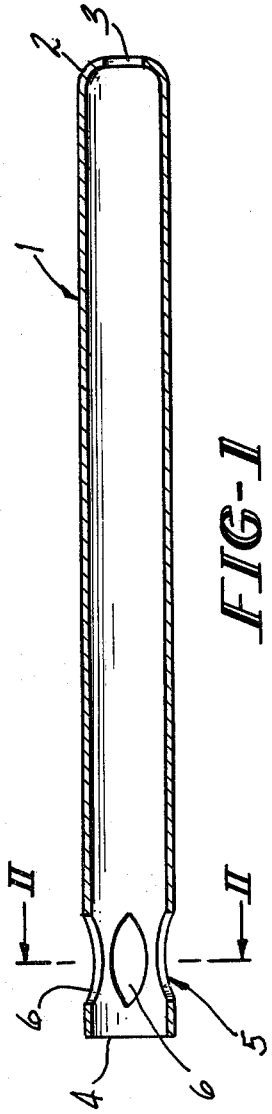
FIG. 1 is a longitudinal cross-sectional view of a first embodiment of the package according to this invention.

In the vicinity of its other end 4, which is open and through which the charges are inserted and dispensed, tube 1 comprises a portion 5 which is resiliently deformable. In this respect, openings 6, for instance substantially in the form of a lozenge elongated in the longitudinal direction of tube 1, have been formed in the wall of portion 5 in such manner as to permit the deformation of the portion and the reduction of its passage cross-section to a smaller dimension than that of the charges in order to hold the latter, as may be seen in FIG. 3. To this end, a resilient ring 7 surrounds portion 5 and bears on parts 8 of its wall which are situated between the openings 6. In the embodiment shown in FIG. 3, parts 8 of the wall of portion 5 are brought near to each other in order to provide a passage cross-section which is reduced in relation to that of the remaining part of body 1, thereby preventing passage of the propellant charges 9.

Figure 3:
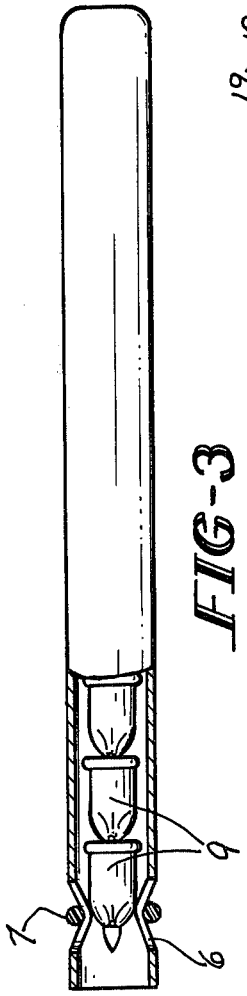
FIG. 3 is a partly sectional view of the package of FIG. 1, its portion being deformed for holding the charges.
Figure 4:
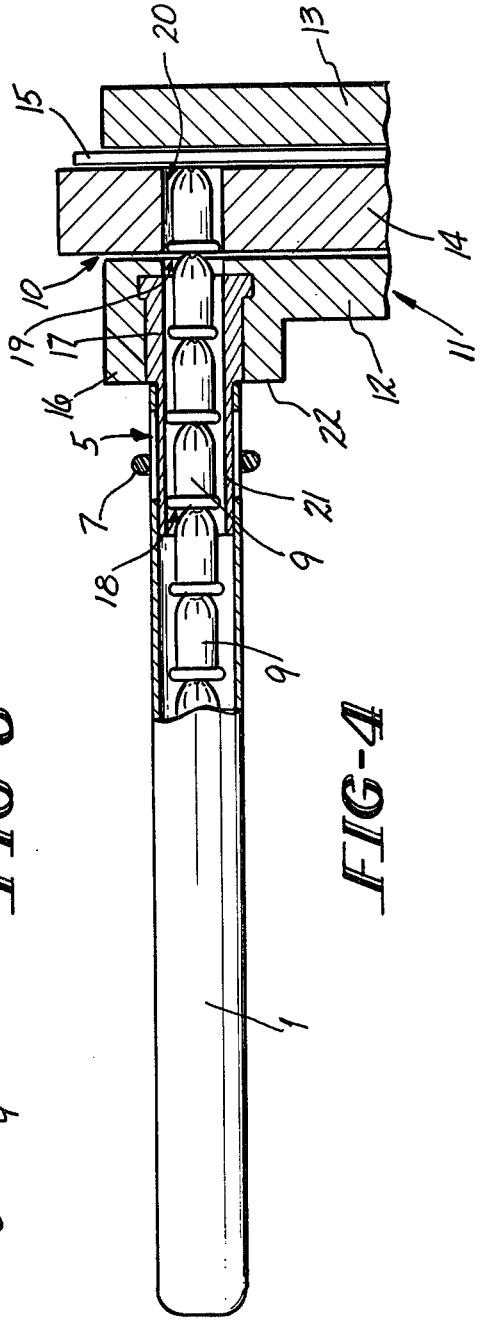
FIG. 4 is a view of the package of FIG. 3 mounted on a fastener driving tool.

The deformation of portion 5 in FIG. 3 may be cancelled, as will be seen in FIG. 4 which shows the package in position on the loading device 10 of a fastener driving tool not shown in the drawing.

The loading device 10 comprises a support 11, formed with two arms 12 and 13, the arm 12 being continued in its upper part by a sleeve 16, and a member 14 for transfering the charges into the tool combustion chamber. Member 14 is preferably pivotally mounted about a pin which is integral with support 11, for movement in a plane perpendicular to the barrel of the tool. A closure plate 15, for member 14, is pivotally mounted between member 14 and arm 13 of support 11. Sleeve 16 comprises an open-ended tubular insert 17, one end 21 of which projects towards the outside of sleeve 16, and bores 18, 19, 20, each having a diameter substantially equal to the outside diameter of charges 9, formed respectively in insert 17, sleeve 16 and transfer member 14, in such manner that the charges 9 may descend by gravity from the body 1 into the transfer member 14.

In FIG. 4, the package is seen mounted on the loading device 10, the end 21 of insert 17, which has an outside diameter substantially equal to the inside diameter of body 1, being introduced in portion 5 of element 1, the latter playing the role of a female part in the assembly which is thus realized.

When the end 21 of insert 17 is being introduced in portion 5, said end draws apart, against the action of the resilient ring 7, the wall parts 8 of portion 5, thus cancelling the initial deformation of the latter and restoring the original tubular shape with a passage cross-section adapted for releasing the charges 9. The body 1, which is in abutment against the forward face 22 of sleeve 16, is maintained upon insert 17 by the constriction provided by ring 7. The charges 9 may then be put in position in the transfer member 14 of the device 10 of the fastener driving tool, from element 1 through gravity.

According to the present invention, the end 21 of insert 17 may be provided with outside and inside bevels 23 for respectively facilitating the introduction of said insert 17 into body 1 and that of the charges 9 in said insert.

The package is thus seen to provide a holding function for the charges when it is not mounted on the loading device 10, and a release function when it is mounted on said device.

Moreover, when the package is disengaged from device 10, parts 8 of the wall of portion 5, which are no longer held by end 21 of insert 17, resiliently resume their initial position under the influence of ring 7, and deform portion 5 to its deformed shape which assumes the holding of charges 9 within body 1

It will be noted that it is after an operation similar to that of mounting the package on insert 17, that said package is initially filled with charges 9.

Figure 5:
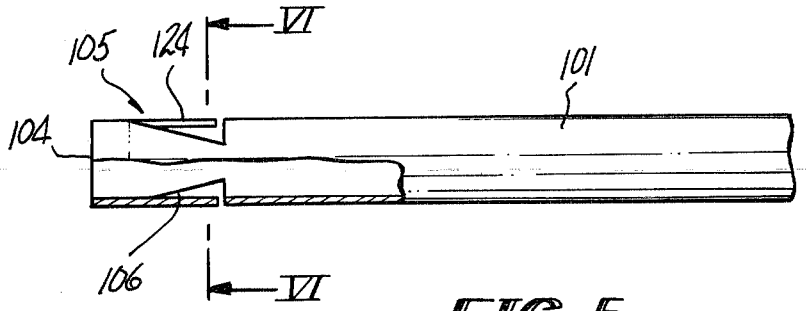
FIG. 5 is a partially cross-sectional view of a second embodiment of the package according to the invention.
Figure 6:
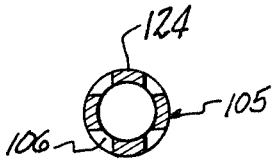
FIG. 6 is a cross-sectional view along line VI—VI of FIG. 5.
Figure 7:
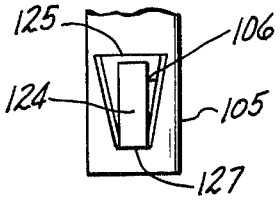
FIG. 7 is a plane view of the deformable portion of the package of FIG. 5.
Figure 8:
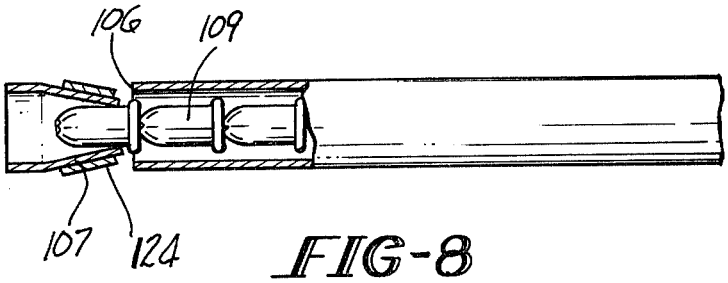
FIG. 8 is a partially cross-sectional view of the package of FIG. 5, its portion being deformed for holding the charges.

FIGS. 5 to 7 show another embodiment of the package according to the invention.

In the vicinity of its open end 104, body 101 comprises a portion 105 which is resiliently deformable. Openings 106 have been formed in the wall of said portion 105 for providing tangs 124, for instance rectangular, which are inwardly biased by a resilient ring 107 in order to protrude inside said portion, and consequently, as in the previous embodiment, to limit the passage cross-section. In this case, the charges 109 can be held inside body 101 through the cooperation of ends 125 of tangs 124 with edges 126 of the charges 109, against which they come in abutment.

Mounting of the package on the loading device of a fastener driving tool, as well as its use in loading the tool, are identical to those of the embodiment previously described.

Figure 9:
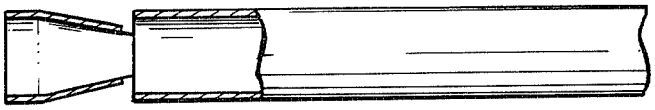
FIG. 9 is a partially cross-sectional view of a third embodiment of the package according to the invention.

As seen in FIG. 9, a portion 105 may also be provided with tangs 124 which are directly manufactured in their inwardly bent position. In such a case, the resilient ring 107 is no longer necessary, areas 127 connecting tangs 124 with the wall portion 105 forming resilient hinges, which, when the package has been removed from the loading device of the tool, automatically urge said tangs towards the inside of portion 105 in order to hold the remaining charges 109.

In the latter case, as, for instance, when body 101 has to be manufactured by extrusion, it is easier to form tangs in their inwardly bent position on a relatively short tubular element. Portion 105 is then separately manufactured, to be thereafter connected, in a manner known in the art, to the non-deformable part of the body 101.

Finally, it is to be noted that the openings formed in the wall of the deformable portion of the body need not be limited to the form of elongated lozenges, as other oblong shapes are envisaged in the present invention. Likewise, the tangs may also assume other shapes and may be, for instance, semi-circular, without departing from the scope of the invention. Accordingly, the scope of the invention is intended to be limited only by the scope of the appended claims.

What is claimed is:

1. In combination with a loading device for a power-actuated tool, a projecting tubular loading port insert adapted for passage of charges therethrough and a self-closing propellant charge package; said loading port insert co-operating with said loading device for the passage of charges thereinto, said charge package comprising a tubular body of a size to receive a plurality of charges in serial alignment and means for biasing a portion of said body, said body having one end at least partially closed to prevent passage of charges therethrough and one end open, said body further including a deformable portion adjacent said open end adapted for reformation between a first, undeformed, condition admitting of ready passage of charges therethrough and a second, deformed, condition wherein passage of charges is prevented, said biasing means biasing said deformable portion to said second condition, said body being adapted for telescoping emplacement on said loading port insert whereby said biasing means is overcome and said deformable portion is returned to a substantially undeformed condition, allowing charges in said body to pass freely through said loading port insert into said loading device.

2. The combination according to claim 1, wherein said deformable portion includes at least one through opening formed in the sidewall of said body.

3. The combination according to claim 2, wherein said opening is elongate in configuration and aligned along the longitudinal axis of said body.

4. The combination according to claim 3, wherein said through opening defines a tang integrally formed in the sidewall of said body, the portion of said tang joining said body comprising a resilient hinge.

5. The combination according to claim 1, wherein said biasing means comprises a resilient member encircling said deformable portion.

6. The combination according to claim 4, wherein said deformable portion is formed with said tang protruding into the interior thereof.

7. In combination with a loading device for a powder-actuated tool, a projecting tubular loading port insert adapted for passage of charges therethrough and a self-closing propellant charge package; said loading port insert co-operating with said loading device for the passage of charges thereinto, said charge package comprising a tubular body of a size to receive a plurality of charges in serial alignment, said body having one end at least partially closed to prevent passage of charges therethrough and one end open, said body further including a portion thereof, adjacent said open end, deformed so as to retain charges contained in said body, said deformation being cancellable, by telescopic emplacement of said open end of said body on said loading port insert, to permit passage of charges, from said body, freely through said loading port insert and into said loading device.

8. The combination of claim 7, further comprising a resilient member encircling said deformed portion and biasing the same toward said deformed state.

9. The combination of claim 7, wherein said deformed portion includes at least one opening formed in the sidewall of said body.

10. The combination of claim 9, wherein said opening defines a tang hingedly connected to said body.

* * * * *